US005348931A

United States Patent [19]

Mochizuki et al.

[11] Patent Number: 5,348,931

[45] Date of Patent: Sep. 20, 1994

[54] SUBLIMATION-TYPE THERMAL IMAGE TRANSFER RECORDING MEDIUM

[75] Inventors: Hidehiro Mochizuki, Numazu; Yutaka Ariga, Fuji; Hiroki Kuboyama, Mishima; Hiroyuki Uemura, Numazu; Chiharu Nogawa, Shizuoka, all of Japan

[73] Assignee: Ricoh Company, Ltd., Tokyo, Japan

[21] Appl. No.: 10,304

[22] Filed: Jan. 28, 1993

[30] Foreign Application Priority Data

Jan. 28, 1992 [JP] Japan ..... 4-037331
Aug. 25, 1992 [JP] Japan ..... 4-248680

[51] Int. Cl.[5] ..... B41M 5/035; B41M 5/38

[52] U.S. Cl. ..... 503/227; 428/195; 428/216; 428/447; 428/913; 428/914

[58] Field of Search ..... 8/471; 428/195, 212, 428/447, 913, 914, 213, 215, 216; 503/227

[56] References Cited

U.S. PATENT DOCUMENTS 5,043,318 8/1991 Kawakami et al. ..... 503/227

*Primary Examiner*—B. Hamilton Hess

*Attorney, Agent, or Firm*—Oblon, Spivak, McClelland, Maier & Neustadt

[57] ABSTRACT

A sublimation-type thermal image transfer recording medium is composed of a support, a dye-containing layer formed on the support, containing a sublimable dye, and a top layer formed on the dye-containing layer, containing a hydrolyzed product of a silane coupling agent. This sublimation-type thermal image transfer recording medium may be composed of a support at least to dye-containing layers formed on the support, containing a sublimable dye and an organic binder agent in which the sublimable dye is dispersed, and a top layer formed on at least the two dye-containing layers, containing a sublimable product of a silane coupling agent. Alternatively, the above sublimation-type thermal image transfer recording medium may be composed of a support, a dye-supply layer formed on the support, containing a sublimable dye and an organic binder agent in which the sublimable dye is dispersed, a dye-transfer layer formed on the dye-supply layer, containing a sublimable dye and an organic binder agent in which the sublimable dye is dispersed and a low-dyeable resin layer formed on the dye-transfer layer, containing an organic binder agent and a hydrolyzed product of a silane coupling agent.

34 Claims, No Drawings

SUBLIMATION-TYPE THERMAL IMAGE TRANSFER RECORDING MEDIUM

BACKGROUND OF THE INVENTION

1. Field of the Invention

The present invention relates to a sublimation-type thermal image transfer recording medium for use with copying machines and printers, and more particularly to a sublimation-type thermal image transfer recording medium for multiple printing recording by a thermal image transfer recording method under the condition that the transporting speed of an image receiving sheet is larger than that of the sublimation-type thermal image transfer recording medium (hereinafter referred to as n-times-speed mode method) when images are printed.

2. Discussion of Background

Recently the demand for full color printers is increasing year by year. Representative examples of recording methods for full color printers now available include the electrophotographic method, the ink-jet method, and the thermosensitive image transfer recording method. Of these methods, the thermosensitive image transfer recording method is most widely employed because of its advantages over the other methods in that the maintenance is easy and the operation is noiseless.

In the thermosensitive image transfer recording method, a thermal image transfer recording medium, which is a so-called color ink sheet, and an image receiving sheet are employed. The thermal image transfer recording medium comprises a support, and an ink layer formed thereon. comprising a color ink is composed of a coloring agent dispersed in a thermofusible material, or a sublimable dye dispersed in a binder agent.

To carry out the thermosensitive image transfer recording, the image receiving sheet is superimposed on the ink layer of the thermal image transfer recording medium and the color ink is transferred imagewise from the thermal image transfer recording medium to the image receiving sheet by thermally fusing of the coloring agent or the sublimation of the sublimable dye under the application of thermal energy to the recording medium by laser beams or through a thermal head which is energized by the electric signals corresponding to the images to be recorded.

The thermosensitive image transfer recording methods can be roughly classified into two types, a thermal fusing image transfer type and a sublimation image transfer type. The sublimation image transfer type is advantageous over the thermal fusing image transfer type in that a halftone can be obtained without difficulty. This advantage can be obtained because a sublimable dye is in principle sublimated in the form of individually separated molecules in such an amount as to correspond to the amount of thermal energy applied thereto, for instance, from a thermal head and transferred to the image receiving sheet. Therefore, the sublimation image transfer type is considered to be most suitable for full color printers.

The sublimation-type thermal image transfer recording method, however, has the shortcoming in that its running, cost is high, because in this image transfer recording method, a yellow ink sheet, a magenta ink sheet, a cyan ink sheet, and if necessary, a black ink sheet, are employed in order to obtain a full color image, with selective application of thermal energy to each ink sheet, and discarded after the recording even though large unused portions remain on each ink sheet.

To eliminate this shortcoming, the Applicants have proposed a sublimation-type thermal image transfer recording medium which has a laminated structure as disclosed in Japanese Patent Application 63-62866. More specifically, the sublimation-type thermal image transfer recording medium comprises a dye-supply layer and a dye-transfer layer. The dye transferable performance of the dye-supply layer to the image receiving sheet is made greater than that of the dye-transfer layer, thereby avoiding the deterioration of the image density even when multiple printing recording is carried out. In other words, when a dye-supply layer and a dye-transfer layer are separately provided in the form of a single layer by coating with their specific formulations in the same deposition amount on each support sheet, each layer is superimposed on an image receiving sheet, and an equal amount of thermal energy is applied to each layer through the support, and there is established the relationship that the amount of the sublimable dye to be transferred from the dye-supply layer to the image receiving sheet is more than the amount of the sublimable dye to be transferred from the dye-transfer layer to the image receiving sheet, the multiple printing recording function by using the sublimation-type thermal image transfer recording medium can be improved.

Furthermore, a multiple printing recording method by which an ink sheet can used repeatedly has been studied not only from the viewpoint of the image transfer recording medium, but also from the view point of a method of bringing the ink sheet into close contact with the image receiving sheet.

Specifically, there has been proposed two methods, an equal-speed mode method and an n-times-speed mode method. In the former method, an ink sheet and an image receiving sheet are moved at the same speed when image printing is repeated. In the latter method, the running speed of the image receiving sheet is n ($n>1$) times the running speed of the ink sheet when image printing is conducted, so that the ink sheet is shifted relative to the image receiving sheet in such a manner that a preceding portion o the ink sheet and the following portion thereof partly overlap with respect to the ink transfer therefrom in the course of the thermal printing. Therefore as a matter of course, the large the value of "n", the larger the cost reduction in printing.

In the n-times-speed mode method, the ink is supplied at least from a newly used portion of the ink sheet in each printing, so that the variations of the amount of a residual ink in the ink sheet can be more minimized in comparison with the equal-speed mode method in which a used portion of the ink sheet is merely used repeatedly. Therefore, the n-times-speed mode method is advantageous over the equalspeed mode method with respect to the minimization of the amount of the residual ink in the ink sheet from the viewpoint of the recording history of the ink sheet as reported in the Journal of the Institute of Electronics and Communication Engineers, Vol. J70-C, No. 11, pages 1537–1544 (1987).

The multiple printing recording method such as the n-times-speed mode method, however, have the drawback that the sublimable dye which has been already transferred to an image receiving layer of the image receiving sheet is transferred back to the ink layer of the thermal image transfer recording medium. As a result, in some cases, the color of the image, when subsequently formed, becomes unclear, and a tailing phenomenon takes place at the edge of the image on the image receiving sheet.

The above-mentioned drawback in the sublimation-type thermal image transfer recording method stems from the thermal diffusion of the sublimable dye from the ink layer of the thermal image transfer recording medium to the image receiving layer, which are closely brought into pressure contact with each other by a thermal head and a platen roller.

When a secondary or tertiary color is formed on the image receiving layer by superimposing two or three dyes in the full color printing process, the dye which has been already transferred to the image receiving layer is transferred back to the ink layer of the thermal image transfer recording medium. This phenomenon is a so-called "reverse transfer". In the case of one-time printing, the thermal image transfer recording sheet in which the reverse transfer has occurred is discarded, so that the above-mentioned problem does not affect the image formation. In the case of multiple printing recording, however, the image reversely transferred to the ink layer of the thermal image transfer recording sheet is transferred again to the other position of the image receiving layer, so that the color turbidity and the tailing phenomenon at the edge of the image and caused, and the subsequent recordings are adversely affected.

Furthermore, the sublimation-type thermal image transfer recording medium has a problem in that an ink layer and an image receiving layer become fused when the thermal recording is conducted, because of the low heat-resistance of an organic binder agent contained in the ink layer on the support and because of the low heat-resistance of an organic binder agent in the image receiving layer.

In addition to the above, when the n-times-speed ode method is employed, the difference between the running speed of the ink layer and that of the image receiving layer generates a frictional force between the surface of the ink layer and that of the image receiving layer. Moreover, the ink layer and the image receiving layer are fused by the application of heat by a thermal head when the recording is conducted. As a result, the improper running and the sticking between the ink layer and the image receiving sheet will take place.

Therefore, for example, a silicone oil is generally contained in the image receiving layer to prevent the thermal fusion of the ink layer of the thermal image transfer recording medium and the image receiving layer. In this case, as the content of the silicone oil in the image receiving layer is increased, the preservability of the printed images deteriorates. On the other hand, in the case where a resin with a high melting point and high heat-resistance is employed as an organic binder agent for use in the ink layer of the thermal image transfer recording medium, images with high density cannot be obtained because of the poor diffusion of the dye from the ink layer to the image receiving layer.

To solve the above-mentioned problem, Japanese Laid-Open Patent Application 3-128287 has disclosed a sublimation-type thermal image transfer recording medium with an ink layer which comprises a hydrolyzed product of a silane coupling agent. This sublimation-type thermal image transfer recording medium, however, has not solved the above-mentioned problem sufficiently.

In view of the above-mentioned facts, the following can be said:

1) Excellent multi printing printing performance cannot be obtained by the thermosensitive image transfer recording media with the conventional dye layer structure even when the deposition amount is increased.

2) In the case of a thermosensitive image transfer recording medium in general use, a dye which is already present on the surface of the image receiving latter of an image receiving sheet prior to the succeeding superimposition of dyes is transferred back to the recording medium. As a result, the problems of the formation of unclear colors, ghost images, and the tailing of images at the edge portions thereof will occur during the succeeding image printings.

3) The organic binder agent contained in the ink layer and the organic binder agent contained in the image receiving layer are fused by the heat from a thermal head during the image printing steps.

4) In the n-times-speed mode method, because there is a difference in the transportation speed between the ink layer and the image receiving layer, and heat is applied thereto during the image printing steps, the ink layer and the image receiving layer are fused unless the contacting surfaces of the ink layer and the image receiving layer have appropriate heat resistance and lubricity.

SUMMARY OF THE INVENTION

Accordingly, an object of the present invention is to provide a sublimation-type thermal image transfer recording medium with high sensitivity, which is capable of yielding clear images by the multiple printing recording method without the formation of ghost images, image tailing at an edge portion of the image, and the ink deposition on the background of images, free from the problem of the thermal fusion of an ink layer and an image receiving layer of an image receiving sheet, and furthermore, capable of running properly without the occurrence of the sticking between the ink layer and the image receiving layer even when the n-times-speed mode method is employed.

The above-mentioned object of the present invention can be achieved by a sublimation-type thermal image transfer recording medium comprising a support, a dye-containing layer formed on the support, which comprises a sublimable dye, and a top layer formed on the dye-containing layer, comprising a hydrolyzed product of a silane coupling agent.

The above-mentioned object of the present invention can also be achieved by a sublimation-type thermal image transfer recording medium comprising a support, at least two dye-containing layers formed on the support, each comprising a sublimable dye and an organic binder agent in which the sublimable dye is dispersed, and a top layer formed on top of the two dye-containing layers, comprising a hydrolyzed product of a silane coupling agent.

Furthermore, the above-mentioned object of the present invention can be achieved by a sublimation-type thermal image transfer recording medium comprising a support, a dye-supply layer formed on the support, comprising a sublimable dye and an organic binder agent in which the sublimable dye is dispersed, a dye-transfer layer formed on the dye-supply layer, comprising a sublimable dye and an organic binder agent in which the sublimable dye is dispersed, and a low-dyeable (i.e., difficult-to-dye) resin layer formed on the dye-transfer layer, comprising a low-dyeable resin and a hydrolyzed product of a silane coupling agent.

DETAILED DESCRIPTION OF THE PREFERRED EMBODIMENTS

Fick's law can be applied to the diffusion of a dye contained in the dye-supply layer and the dye-transfer layer which constitute an ink layer. More specifically, the amount (dn) of the dye which passes through a sectional area (q) of the ink layer for a period of time (dt) is represented by the following equation:

$$dn = -D(dc/dx)qdt$$

where dc/dx is the dye concentration gradient in the direction of the diffusion of the dye, and D is the average diffusion coefficient in each section of the ink layer when heat is applied.

To improve the diffusion of the sublimable dye from the dye-supply layer to the dye-transfer layer, the following can be carried out:

(I) the concentration of the sublimable dye in the dye-supply layer is set higher than that in the dye-transfer layer, and/or (II) the diffusion coefficient of the'sublimable dye in the dye-supply layer is set higher than that in the dye-transfer layer.

In the present invention, it is preferable that the thickness of the dye-transfer layer and that of the low-dyeable resin layer be 0.05 to 5 μm, more preferably 0.1 to 2 μn. The thickness of the dye-supply layer is preferably from 0.1 to 20 μm, more preferably from 0.5 to 10 μn.

In the dye-transfer layer and the dye-supply layer for use in the present invention, conventional sublimable dyes and organic binder agents can be employed.

Any disperse and oil-soluble dyes which can sublime or vaporize at a temperature of 60° C. or more, preferably disperse and oil soluble dyes, which are ordinarily used in the field of thermal image transfer recording, can be used in the dye-transfer layer and the dye-supply layer of the sublimation-type thermal image transfer recording medium of the present invention.

Specific examples of the sublimable dyes include C.I. Disperse Yellows 1, 3, 8, 9, 16, 41, 54, 60, 77, and 116; C.I. Disperse Reds 1, 4, 6, 11, 15, 17, 55, 59, 60, 73, and 83; C.I. Disperse Blues 3, 14, 19, 26, 56, 60, 64, 72, 99, and 108; C.I. Solvent Yellows 77 and 116; C.I. Solvent Reds 23, 25, and 27; and C.I. Solvent Blues 36, 83, and 105. These dyes can be used alone or in combination.

The concentration of such sublimable dye in the dye-transfer layer and the low-dyeable resin layer is generally in the range of 5 to 80 wt.%, and preferably in the range of about 10 to 60 wt.% of the entire weight of each of these layers.

It is preferable that the concentration of the sublimable dye in the dye-supply layer be 5 to 80%. In the case where a dye concentration gradient is made between the dye-transfer layer and the dye-supply layer, it is preferable that the dye concentration in the dye-supply layer be 1.1 to 5 times, more preferably 1.5 to 3 times the dye concentration in the dye-transfer layer.

To replenish the dye-transfer layer with the sublimable dye constantly and achieve a satisfactory printing performance over an extended period of time, it is preferable that the dye-supply layer contain at least a sublimable dye in the state of undissolved particles, that is, in the form of granules. The state of undissolved particles means such a state that can be obtained when a coating liquid for the dye-supply layer comprising an organic binder agent, a sublimable dye and a solvent is prepared, the sublimable dye partly separates out in the form of granules because of insufficient dissolving of the sublimable dye in the organic binder resin after the coating liquid for the dye-supply layer is dried.

The conditions of the granular sublimable dye in the dye-supply layer vary depending on the kind of solvent employed, even though the same organic binder agent and the same sublimable dye are employed. The presence of the granular sublimable dye, which separates out in the dye-supply layer, can be easily recognized by an electron microscope after the formation of the dye-supply layer. The particle diameter of the granular dye varies depending upon the thickness of the dye-supply layer, but is generally in the range of 0.01 to 20 μm, and preferably in the range of 1.0 to 5μm.

In the dye-transfer layer and the low-dyeable resin layer for use in the present invention, it is desirable that the sublimable dye be present in the form of independent molecules which in practice contribute to the image transfer to the image receiving sheet, in order that the formation of transferred images with uneven image density can be prevented, and the dye concentration gradient between the dye-supply layer and the dye-transfer layer can be stabilized.

Thermoplastic resins and thermosetting resins can be used as the organic binder agents in the dye-transfer layer and dye-supply layer for use in the present invention.

Specific examples of such thermoplastic resins and thermosetting resins include vinyl chloride resin, vinyl acetate resin, polyamide, polyethylene, polycarbonate, polystyrene, polypropylene, acrylic resin, phenolic resin, polyester, polyurethane, epoxy resin, silicone resin, fluoroplastics resin, butyral resin, melamine resin, natural rubber, synthetic rubber, polyvinyl alcohol, and cellulose resin. These resins have a relatively high glass transition temperature or softening point, and can be used alone or in combination. In addition, a variety of copolymers prepared from the monomers used in the above resins can be employed.

Furthermore, to make the glass transition temperature or softening point of the dye-transfer layer differ from that of the dye-supply layer, resins and natural or synthetic rubbers with a glass transition temperature of 0° C. or less, or a softening point of 60° C. or less, are preferably used as the organic binder agents.

Specific examples of such resins include polyethylene oxides, such as commercially available products, "Alkox E-30", "Alkox E-45", "Alkox R-150", "Alkox R-400", and "Alkox R-1000" (Trademarks), made by Meisei Chemical Works, Ltd.; and caprolactone polyols, such as commercially available products, "Placcel H-1", "Placcel H-4" and "Placcel H-7" (Trademarks), made by Daicel Chemical industries, Ltd. The above-mentioned polyethylene oxides and caprolactone polyols are preferable in practice. It is preferable that the thermoplastic resins and thermosetting resins as previously mentioned be used in combination with one or more such resins.

The low-dyeable resin layer for the sublimation-type thermal image transfer recording medium according to the present invention will now be described in detail.

Low-dyeable resins suitable for use in the low-dyeable resin layer are such resins that yield low recording image density when evaluated as an organic binder agent for an image receiving layer. More specifically, the low-dyeable resins for use in the present invention are chosen in accordance with the following evaluation:

Each sample resin is dissolved in a volatile solvent to such a degree that the amount of the resin is 5 to 20 wt.% of the total weight of the mixture, so that a resin solution is prepared. A mixture of commercially available modified silicone oils, "SF8411" and "SF8427" (Trademarks), made by Dow Corning Toray Silicone Co., Ltd., at the mixing ratio by weight of 1:1, is added to the above-prepared resin solution to prepare a coating solution with the solid resin component thereof being 30 wt.%. The thus prepared coating liquid is coated on a sheet of commercially available synthetic paper "Yupo FPG#95" (Trademark), made by Oji-Yuka Synthetic Paper Co., Ltd., serving as a base sheet, and dried at 70° C. for one minute, and at room for more than one day, so that a resin layer with a thickness of 10 μm on a dry basis is formed on the base sheet. Thus, a variety of image receiving sheets are prepared.

A commercially available thermal image transfer ink ribbon, "Color Sheet" for Mitsubishi color video processor "SCT-CP200", which is cyan, is overlaid on each of the above-prepared image receiving sheets. Then, thermal image transfer is conducted with the application of the thermal energy of 2 mJ/dot to the thermal image transfer ink ribbon by using a commercially available thermal head "KMT-85-6MPD4" (Trademark), made by Kyocera Corp., with a resolution of 6 dots/mm and an average resistivity of 542 Ω. The density of images thus transferred to the image receiving sheet is measured by a reflection-type densitometer RD-918. As a result, in the case where the density of images obtained on the image receiving sheet is 1.2 or less, preferably 1.0 or less, the resin used in the resin layer of the image receiving sheet is considered usable as the low-dyeable resin for the low-dyeable resin layer of the sublimation-type thermal image transfer recording medium according to the present invention.

Resins which are found suitable as low-dyeable resins for the low-dyeable resin layer by the above evaluation are: aromatic polyester resin, styrene - butadiene resin, polyvinyl acetate resin and polyamide resin. Furthermore, preferable examples of the resin for use in the low-dyeable resin layer include methacrylate polymer, methacrylate copolymer, styrene - maleic acid ester copolymer, polyimide resin, acetate resin, silicone resin, styrene - acrylonitrile resin, and polysulfone resin.

The low-dyeable resin layer for use in the present invention comprises a hydrolyzed product of a silane coupling agent.

The hydrolyzed product of a silane coupling agent for use in the present invention can be obtained by mixing a bifunctional silane coupling agent and a trifunctional silane coupling agent, and hydrolyzing the mixture in an organic solvent with the addition of water, or an acidic or alkaline catalyst.

Specific examples of the bifunctional silane coupling agent are dimethyldichlorosilane, diphenyldichlorosilane, dimethyldimethoxysilane, dimethyldiethoxysilane, diphenyldimethoxysilane, γ-glycideoxypropylmethyldiethoxysilane, and N-β(aminoethyl)γ-aminopropylmethyldimethoxysilane.

Specific examples of the trifunctional silane coupling agent are methyltrichlorosilane, phenyltrichlorosilane, methyltrimethoxysilane, phenyltriethoxysilane, γ-methacryloxypropyltrimethoxysilane, γ-aminopropyltrimethoxysilane, γ-aminopropyltriethoxysilane, and γ-chloropropyltrimethoxysilane.

The hydrolyzed product of the silane coupling agent useful because it has both lubricating effects attained by the bifunctional silane coupling agent and the heat-resistance-imparting effects provided by a three-dimensional cross-linking reaction of the trifunctional silane coupling agent.

It is preferable that the molar ratio of the bifunctional silane coupling agent to the trifunctional silane coupling agent be within the range from (2:1) to (1:10).

This is because when the relative amount of the bifunctional silane coupling agent is more than that in the above range, the heat-resistance-imparting effects provided by the trifunctional silane coupling agent tend to decrease, while when the relative amount of the trifunctional silane coupling agent is more than that the lubricating effects provided by the bifunctional coupling agent tend to decrease.

In addition, when the amount of the hydrolyzed product of the silane coupling agent is 20 to 200 parts by weight to 100 parts by weight of the low-dyeable resin, the above-mentioned lubricating effects and heat-resistance-imparting effects of the hydrolyzed product of the silane coupling agent can be further improved.

As the materials for the support of the sublimation-type thermal image transfer recording medium according to the present invention, condenser paper, polyester, polystyrene, polysulfone, polyimide, and polyamide films can be used.

When necessary, a conventional adhesive layer may be interposed between the support and the dye-supply layer, and a conventional heat-resistant lubricating layer may be formed on the back side of the support, opposite to the dye-supply layer.

In the above, the three-layered ink layer consisting of the dye-supply layer, the dye-transfer layer and the low-dyeable resin layer has been explained. However, an ink layer composed of four or more layers can also be employed so long as the transferred amount of dye from each layer can be appropriately made different and the function separation with respect to each layer can be attained so as to meet the objects of the present invention.

The sublimation-type thermal image transfer recording medium according to the present invention can be applied to the thermal image transfer by using a thermal head, as previously mentioned. In addition, thermal image transfer using the thermal image transfer recording medium of the present invention can also be achieved by bringing a heat plate into contact with the recording medium, applying laser beams thereto or causing an electric current to flow through the support and/or the ink layer of the recording medium so as to generate Joule's heat therein in the recording medium, for instance, by the so-called electrothermic non-impact printing. The electrothermic non-impact printing method is described in a number of references, such as U.S. Pat. No. 4,103,066 and Japanese Laid-Open Patent Applications 57-14060, 57-11080 and 59-9096.

When the electrothermic non-impact printing method is employed, the following supports can be used for the sublimation-type thermal image transfer recording medium according to the present invention supports made so as to have an intermediate electric resistivity between the electric resistivities of electroconductive material and insulating material, for example, which are prepared by dispersing finely-divided electroconductive particles, such as finely-divided metal particles of aluminum, copper, iron, tin, zinc, nickel, molybdenum and silver and/or carbon black, in a resin having a relatively high heat-resistance, such as polyester, polycarbonate, triacetyl cellulose, nylon, polyimide or aromatic polyamide; and supports made of the above-mentioned resins, with any of the above-mentioned electroconductive metals deposited thereon by vacuum deposition or sputtering.

It is preferable that the thickness of the above support be in the range of approximately 2 to 15 μm when the thermal conductivity thereof for the generated Joule's heat is taken into consideration.

When laser beams are employed for image transfer, it is preferable that the support absorb laser beams and generate heat. For this purpose, for example, an agent which absorbs light and converts the light into heat, such as carbon black, may be contained in a conventional thermal image transfer film to prepare a support. Alternatively, a light-absorbing and heat-generating layer may be laminated on the front and/or back surface of the support.

Other features of this invention will become apparent in the course of the following description of exemplary embodiments, which are given for illustration of the invention and are not limiting thereof.

EXAMPLE 1

A silicone resin was coated on one side of a film of aromatic polyamide with a thickness of 6 μm, serving as a support, so that a silicone resin layer with a thickness of 1 μm was formed on one side of the support.

Preparation of Coating Liquid for Dye-containing Layer

The following components were mixed to prepare a coating liquid for a dye-containing layer

| | Parts by Weight |
|---|---|
| Polyvinyl butyral resin "BX-1" (Trademark) made by Sekisui Chemical Co., Ltd. | 10 |
| Sublimable dye "HSO144" (Trademark) made by Mitsui Toatsu Chemicals, Inc. | 8 |
| Toluene | 95 |
| Methyl ethyl ketone | 95 |

The above prepared dye-containing layer coating liquid was coated on the other side of the support, opposite to the silicone resin layer, using a wire bar, so that a dye-containing layer with a thickness of 1.5 μm was formed on the support.

Preparation of Coating Liquid for Top Layer

Synthesis of Hydrolyzed Product of Silane Coupling Agent 24 g of diphenyldimethoxysilane and 14 g of methyltrimethoxysilane were dissolved in a mixed solvent of 50 g of toluene and 50 g of methyl ethyl ketone. With the addition of 3 ml of a 3% sulfuric acid, the above solution was hydrolyzed for three hours, whereby a hydrolyzed product of a silane coupling agent for use in a top layer coating liquid was prepared.

The following components were mixed to prepare a coating liquid for a top layer:

| | Parts by Weight |
|---|---|
| Polydimethyl methacrylate "Dianal BR-85" (Trademark) made by Mitsubishi Rayon Engineering Co., Ltd. | 5 |
| Hydrolyzed product of silane coupling agent | 20 |
| Tetrahydrofuran | 20 |

The above prepared top layer coating liquid was coated on the dye-containing layer using a wire bar, so that a top layer with a thickness of 0.5 μm was formed on the dye-containing layer. Thus, a sublimation-type thermal image transfer recording medium No. 1 according to the present invention was prepared.

EXAMPLE 2

The procedure for preparation of the sublimation-type thermal image transfer recording medium No. 1 in Example 1 was repeated except that the top layer in the recording medium No. 1 was replaced by a second dye-containing layer with a thickness of 1.5 μm, which was provided by coating a coating liquid with the following formulation on the first provided dye-containing layer by a wire bar, whereby a sublimation-type thermal image transfer recording medium No. 2 according to the present invention was prepared:

| | Parts by Weight |
|---|---|
| Polyvinyl butyral resin "BX-1" (Trademark) made by Sekisui Chemical Co., Ltd. | 10 |
| Hydrolyzed product of silane coupling agent | 5 |
| Sublimable dye "HSO144" (Trademark) made by Mitsui Toatsu Chemicals, Inc. | 8 |
| Toluene | 95 |
| Methyl ethyl ketone | 95 |

COMPARATIVE EXAMPLE 1

The procedure for preparation of the sublimation-type thermal image transfer recording medium No. 1 in Example 1 was repeated except that the hydrolyzed product of the silane coupling agent employed in the top layer in Example 1 was eliminated therefrom, whereby a comparative sublimation-type thermal image transfer recording medium No. 1 was prepared.

COMPARATIVE EXAMPLE 2

A support provided with a silicone resin layer was prepared by the same method as in Example 2.

A first dye-containing layer coating liquid prepared in the same manner as employed for the preparation of the dye-containing layer coating liquid in Example 2 was coated on the other side of the support, opposite to the silicone resin layer, using a wire bar, whereby a first dye-containing layer with a thickness of 1.5 μm was formed on the support. A second dye-containing layer coating liquid prepared in the same manner as employed for preparation of the top layer coating liquid in Example 2 was coated on the first dye-containing layer, using a wire bar, whereby a second dye-containing layer with a thickness of 1.5 μm was formed on the first dye-containing layer.

Preparation of Coating Liquid for Third Dye-containing Layer

The following components were mixed to prepare a coating liquid for a third dye-containing layer

| | Parts by Weight |
|---|---|
| Cellulose acetate butyrate "CAB 381-05" (Trademark) made by Eastman Kodak Asia Pacific Ltd. | 5 |
| Sublimable dye "HSO144" (Trademark) made by Mitsui Toatsu Chemicals, Inc. | 5 |
| Toluene | 20 |
| Methyl ethyl ketone | 20 |

The above prepared third dye-containing layer coating liquid was coated on the second dye-containing layer, using a wire bar, so that a third dye-containing layer with a thickness of 0.5 μm was formed on the second dye-containing layer. Thus, a comparative sublimation-type thermal image transfer recording medium No. 2 was prepared.

COMPARATIVE EXAMPLE 3

The procedure for preparation of the sublimation-type thermal image transfer recording medium in Example 2 was repeated except that the hydrolyzed product of the silane coupling agent employed in the second dye-containing layer in Example 2 was eliminated therefrom, so that a comparative sublimation-type thermal image transfer recording medium No. 3 was prepared.

COMPARATIVE EXAMPLE 4

A support provided with a silicone resin layer was prepared by the same method as in Example 1.

Preparation of Coating Liquid for Dye-containing Layer

The following components were mixed to prepare a coating liquid for a dye-containing layer

| | Parts by Weight |
|---|---|
| Polyvinyl butyral resin "BX-1" (Trademark) made by Sekisui Chemical Co., Ltd. | 10 |
| Silicone Oil "DC28PA" (Trademark) made by Dow Corning Toray Silicone Co., Ltd. | 2 |
| Sublimable dye "HSO144" (Trademark) made by Mitsui Toatsu Chemicals, Inc. | 8 |
| Toluene | 95 |
| Methyl ethyl ketone | 95 |

The above prepared dye-containing layer coating liquid was coated on the support, using a wire bar, so that a dye-containing layer with a thickness of 1.5 μm was formed on the other side of the support, opposite to the silicone resin layer. Thus, a comparative sublimation-type thermal image transfer recording medium No. 4 was prepared.

Thermal Printing Test 1

Each of the sublimation-type thermal image transfer recording media No. 1 and No. 2 prepared in Examples 1 and 2 according to the present invention, and the comparative sublimation-type thermal image transfer recording media No. 1 to No. 4 prepared in Comparative Examples 1 to 4 was subjected to a thermal recording test to investigate the thermal fusion and the occurrence of sticking, using an image receiving sheet prepared by the following method:

Preparation of Image Receiving Sheet

The following components were thoroughly mixed and dispersed to prepare a coating liquid for providing an image receiving layer:

| | Parts by Weight |
|---|---|
| Vinyl chloride - vinyl acetate - vinyl alcohol copolymer "VAGH" (Trademark) made by Union Carbide Japan K.K. | 10 |
| Diisocyanate "Coronate L" (Trademark) made by Nippon Polyurethane Industry Co., Ltd. | 5 |
| Amino-modified silicone "SF8417" (Trademark) made by Dow Corning Toray Silicone Co., Ltd. | 0.5 |
| Epoxy-modified silicone "SF8411" (Trademark) made by Dow Corning Toray Silicone Co., Ltd. | 0.5 |
| Toluene | 40 |
| Methyl ethyl ketone | 40 |

The above prepared coating liquid for an image receiving layer was coated on a sheet of commercially available synthetic paper with a thickness of about 150 μm, "Yupo FPG-150" (Trademark) made by Oji-Yuka Synthetic Paper Co., Ltd., using a wire bar, dried at 75° C. for one minute to form an image receiving layer with a thickness of about 5 μm, and then cured at 80° C. for three hours, whereby an image receiving sheet was prepared.

Thermal recording was carried out by the n-times-speed mode method under the following conditions:

| | |
|---|---|
| Resolution of thermal head: | 12 dots/mm |
| Applied energy: | 0.65 mJ/dot |
| Applied electric power: | 0.16 W/dot |
| [N = 1] | |
| Transporting speed of the image receiving sheet: | 8.4 mm/sec |
| Transporting speed of the thermal image transfer recording medium: | 8.4 mm/sec |
| [N = 3] | |
| Transporting speed of the image receiving sheet: | 8.4 mm/sec |
| Transporting speed of the thermal image transfer recording medium: | 2.8 mm/sec |
| [N = 5] | |
| Transporting speed of the image receiving sheet: | 8.4 mm/sec |
| Transporting speed of the thermal image transfer recording medium: | 1.68 mm/sec |

The results of the test are shown in Table 1.

TABLE 1

| | Thermal Fusion | Occurrence of Sticking | |
|---|---|---|---|
| | N = 1 | N = 3 | N = 5 |
| Ex. 1 | None | None | None |
| Ex. 2 | None | None | None |
| Com. Ex. 1 | Observed | Observed | Observed |
| Com. Ex. 2 | Observed | Observed | Observed |

TABLE 1-continued

| | Thermal Fusion | Occurrence of Sticking | |
|---|---|---|---|
| | N = 1 | N = 3 | N = 5 |
| Com. Ex. 3 | Observed | Observed | Observed |
| Com. Ex. 4 | None | Slightly Observed | Observed |

EXAMPLE 3

A silicone resin was coated on one side of a film of aromatic polyamide with a thickness of 6 μm, serving as a support, so that a heat-resistant silicone resin layer with a thickness of 1 μm was formed on the support.

Preparation of Coating Liquid for Intermediate Adhesive Layer

The following components were mixed to prepare a coating liquid for an intermediate adhesive layer:

| | Parts by Weight |
|---|---|
| Polyvinyl butyral resin "BX-1" (Trademark) made by Sekisui Chemical Co., Ltd. | 10 |
| Diisocyanate "Coronate L" (Trademark) made by Nippon Polyurethane Industry Co., Ltd. | 5 |
| Toluene | 95 |
| Methyl ethyl ketone | 95 |

The above prepared coating liquid for an intermediate adhesive layer was coated on the other side of the support, opposite to the heat-resistant silicone resin layer, so that an intermediate adhesive layer with a thickness of 1.0 μm was formed on the support.

Preparation of Coating Liquid for Dye-supply Layer

The following components were mixed to prepare a coating liquid for a dye-supply layer:

| | Parts by Weight |
|---|---|
| Polyvinyl butyral resin "BX-1" (Trademark) made by Sekisui Chemical Co., Ltd. | 7 |
| Polyethylene oxide "Alkox R-400" (Trademark) made by Meisei Chemical Works, Ltd. | 3 |
| Diisocyanate "Coronate L" (Trademark) made by Nippon Polyurethane Industry Co., Ltd. | 3 |
| Sublimable dye "HSO144" (Trademark) made by Mitsui Toatsu Chemicals, Inc. | 30 |
| Toluene | 95 |
| Methyl ethyl ketone | 95 |

The above prepared coating liquid for a dye-supply layer was coated on the intermediate adhesive layer formed on the support, using a wire bar, so that a dye-supply layer with a thickness of 4.5 μm was formed on the intermediate adhesive layer.

Preparation of Coating Liquid for Dye-transfer Layer

The following components were mixed to prepare a coating liquid for a dye-transfer layer:

| | Parts by Weight |
|---|---|
| Polyvinyl butyral resin | 10 |

-continued

| | Parts by Weight |
|---|---|
| "BX-1" (Trademark) made by Sekisui Chemical Co., Ltd. | |
| Diisocyanate "Coronate L" (Trademark) made by Nippon Polyurethane Industry Co., Ltd. | 3 |
| Sublimable dye "HSO144" (Trademark) made by Mitsui Toatsu Chemicals, Inc. | 20 |
| Toluene | 45 |
| Methyl ethyl ketone | 45 |
| Dioxane | 100 |

The above prepared coating liquid for a dye-transfer layer was coated on the dye-supply layer, using a wire bar, so that a dye-transfer layer with a thickness of 1.0 μm was formed on the dye-supply layer.

Preparation of Coating Liquid for Low-dyeable Resin Layer

Synthesis of Hydrolyzed Product of Silane Coupling Agent 27.2 g of methyltrimethoxysilane was dissolved in a mixed solvent of 50 g of toluene and 50 g of methyl ethyl ketone. With the addition of 3 ml of a 3% sulfuric acid, the above solution was hydrolyzed for three hours, whereby a hydrolyzed product of silane coupling agent for use in a low-dyeable resin layer was prepared.

The following components were mixed to prepare a coating liquid for a low-dyeable resin layer:

| | Parts by Weight |
|---|---|
| Polydimethylmethacrylate "Dianal BR-85" (Trademark) made by Mitsubishi Rayon Engineering Co., Ltd. | 5 |
| Hydrolyzed product of silane coupling agent | 20 |
| Sublimable dye "HSO144" (Trademark) made by Mitsui Toatsu Chemicals, Inc. | 5 |
| Tetrahydrofuran | 20 |

The above prepared coating liquid for a low-dyeable resin layer was coated on the dye-transfer layer, using a wire bar, so that a low-dyeable resin layer with a thickness of 0.7 μm was formed on the dye-transfer layer. Thus, an ink sheet was obtained. The thus obtained ink sheet was then cured at 60° C. for 24 hours, whereby a sublimation-type thermal image transfer recording medium No. 3 according to the present invention was prepared.

EXAMPLE 4

The procedure for preparation of the sublimation-type thermal image transfer recording medium No. 3 in Example 3 was repeated except that the coating liquid for the low-dyeable resin layer used in Example 3 was replaced by a coating liquid for a low-dyeable resin layer prepared with the following formulation, whereby a sublimation-type thermal image transfer recording medium No. 4 according to the present invention was prepared:

Preparation of Coating Liquid for Low-dyeable Resin Layer

Synthesis of Hydrolyzed Product of Silane Coupling Agent 24 g of diphenyldimethoxysilane and 9 g of vinyl triethoxysilane were dissolved in a mixed solvent of 50 g of toluene and 50 g of methyl ethyl ketone. With the addition of 10 ml of a 1% sulfuric acid, the above solution was hydrolyzed for three hours. The thus obtained reaction mixture was stirred with the addition of 150 ml of water and 50 ml of toluene for 1 hour. After the completion of the stirring, a toluene layer was separated out. The separated toluene layer was dried over anhydrous sodium sulfate overnight. Subsequently, the toluene was distilled away, whereby an oily hydrolyzed product was obtained. The thus obtained oily hydrolyzed product was diluted to 50% with dioxane, so that a hydrolyzed product of silane coupling agent for use in a low-dyeable resin layer was prepared.

The following components were mixed to prepare a coating liquid for a low-dyeable resin layer:

| | Parts by Weight |
|---|---|
| Styrene - maleic acid copolymer "Suprapal AP30" (Trademark) made by BASF Japan Ltd. | 5 |
| Hydrolyzed product of silane coupling agent | 6 |
| Sublimable dye "HSO144" (Trademark) made by Mitsui Toatsu Chemicals, Inc. | 5 |
| Tetrahydrofuran | 20 |

The procedure for preparation of the sublimation-type thermal image transfer recording medium in Example 3 was repeated except that the coating liquid for the low-dyeable resin layer used in Example 3 was replaced by a coating liquid for a low-dyeable resin layer prepared with the following formulation, whereby a sublimation-type thermal image transfer recording medium No. 5 according to the present invention was prepared:

Preparation of Coating Liquid for Low-dyeable Resin Layer

Synthetic of Hydrolyzed Product of Silane Coupling Agent 15 g of dimethylmethoxysilane and 9 g of methyltrimethoxysilane were dissolved in a mixed solvent of 12 g of toluene and 12 g of methyl ethyl ketone. With the addition of 13 ml of a 3% sulfuric acid, the above solution was hydrolyzed for three hours, whereby a hydrolyzed product of silane coupling agent for use in a low-dyeable resin layer was prepared.

The following components were mixed to prepare the above-mentioned coating liquid for the low-dyeable resin layer:

| | Parts by Weight |
|---|---|
| Styrene - maleic acid copolymer "Suprapal AP30" (Trademark) made by BASF Japan Ltd. | 5 |
| Hydrolyzed product of silane coupling agent | 12 |
| Sublimable dye "HSO144" (Trademark) made by Mitsui Toatsu Chemicals, Inc. | 5 |
| Tetrahydrofuran | 20 |

The procedure for preparation of the sublimation-type thermal image transfer recording medium No. 3 in Example 3 was repeated except that the hydrolyzed product of silane coupling agent employed the low-dyeable resin layer in Example 3 was eliminated, whereby a comparative sublimation-type thermal image transfer recording medium No. 5 was prepared.

Thermal Printing Test 2

Each of the sublimation-type thermal image transfer recording media No. 3 to No. 5 in Examples 3 to 5 according to the present invention, and the comparative sublimation-type thermal image transfer recording medium No. 5 in Comparative Example 5 was subjected to the same thermal recording test as in Thermal Printing Test 1 under the following conditions, using the same image receiving sheet as used in Thermal Printing Test 1:

| | |
|---|---|
| Resolution of thermal head: | 12 dots/mm |
| Applied energy: | 0.64 mJ/dot |
| Applied electric power: | 0.16 W/dot |
| [N = 7] | |
| Transporting speed of the image receiving sheet: | 8.4 mm/sec |
| Transporting speed of the thermal image transfer recording medium: | 1.2 mm/sec |
| [N = 14] | |
| Transporting speed of the image receiving sheet: | 8.4 mm/sec |
| Transporting speed of the thermal image transfer recording medium: | 0.6 mm/sec |
| [N = 21] | |
| Transporting speed of the image receiving sheet: | 8.4 mm/sec |
| Transporting speed of the thermal image transfer recording medium: | 0.4 mm/sec |

The results of the test are shown in Table 2.

TABLE 2

| | Occurrence of Sticking | | |
|---|---|---|---|
| | N = 7 | N = 14 | N = 21 |
| Ex. 3 | None | Slightly Observed | Slightly Observed |
| Ex. 4 | None | None | Slightly Observed |
| Ex. 5 | None | None | None |
| Com. Ex. 5 | None | Observed | Observed |

EXAMPLE 6

The procedure for preparation of the sublimation-type thermal image transfer recording medium No. 3 in Example 3 was repeated except that the coating liquid for the low-dyeable resin layer used in Example 3 was replaced by a coating liquid for a low-dyeable resin layer prepared with the following formulation, whereby a sublimation-type thermal image transfer recording medium No. 6 according to the present invention was prepared:

Preparation of Coating Liquid for Low-dyeable Resin Layer

Synthesis of Hydrolyzed Product of Silane Coupling Agent

A mixture of 20 g of dimethyldimethoxysilane and 113.3 g of methyltrimethoxysilane was hydrolyzed with the addition of 10 ml of a 3% sulfuric acid thereto for three hours, whereby a hydrolyzed product of silane coupling agent for use in a low-dyeable resin layer was prepared.

The following components were mixed to prepare the above mentioned coating liquid for the low-dyeable resin layer:

| | Parts by Weight |
|---|---|
| Styrene - maleic acid copolymer "Suprapal AP30" (Trademark) made by BASF Japan Ltd. | 5 |
| Hydrolyzed product of silane coupling agent | 10 |
| Sublimable dye "HSO144" (Trademark) made by Mitsui Toatsu Chemicals, Inc. | 5 |
| Tetrahydrofuran | 20 |

EXAMPLE 7

The procedure for preparation of the sublimation-type thermal image transfer recording medium in Example 3 was repeated except that the coating liquid for the low-dyeable resin layer was replaced by a coating liquid for a low-dyeable resin layer prepared with the following formulation, whereby a sublimation-type thermal image transfer recording medium No. 7 according to the present invention was prepared:

Preparation of Coating Liquid for Low-dyeable Resin Layer

Synthesis of Hydrolyzed Product of Silane Coupling Agent

A mixture of 35.0 g of dimethyldimethoxysilane and 20 of methyltrimethoxysilane was hydrolyzed with the addition of 10 ml of a 3% sulfuric acid thereto for three hours, whereby a hydrolyzed product of silane coupling agent for use in a low-dyeable resin layer was prepared.

The following components were mixed to prepare the above-mentioned coating liquid for the low-dyeable resin layer:

| | Parts by Weight |
|---|---|
| Styrene - acrylonitrile resin "Sanrex SAN-H" (Trademark) made by Mitsubishi Monsanto Chemical Co. | 5 |
| Hydrolyzed product of silane coupling agent | 1 |
| Sublimable dye "HSO144" (Trademark) made by Mitsui Toatsu Chemicals, Inc. | 5 |
| Tetrahydrofuran | 20 |

EXAMPLE 8

The procedure for preparation of the sublimation-type thermal image transfer recording medium in Example 3 was repeated except that the coating liquid for the low-dyeable resin layer was replaced by a coating liquid for a low-dyeable resin layer prepared with the following formulation, whereby a sublimation-type thermal image transfer recording medium No. 8 according to the present invention was prepared:

Preparation of Coating Liquid for Low-dyeable Resin Layer

Synthesis of Hydrolyzed Product of Silane Coupling Agent

A mixture of 24 g of dimethyldimethoxysilane and 326 g of methyltrimethoxysilane was hydrolyzed with the addition of 10 ml of a 3% sulfuric acid thereto for three hours, whereby a hydrolyzed product of silane coupling agent for use in a low-dyeable resin layer was prepared.

The following components were mixed to prepare the above mentioned coating liquid for the low-dyeable resin layer:

| | Parts by Weight |
|---|---|
| Polydimethyl methacrylate "Dianal BR-85" (Trademark) made by Mitsubishi Rayon Engineering Co., Ltd. | 5 |
| Hydrolyzed product of silane coupling agent | 5 |
| Sublimable dye "HSO144" (Trademark) made by Mitsui Toatsu Chemicals, Inc. | 5 |
| Tetrahydrofuran | 20 |

EXAMPLE 9

The procedure for preparation of the sublimation-type thermal image transfer recording medium No. 3 in Example 3 was repeated except that the coating liquid for the low-dyeable resin layer employed in Example 3 was replaced by a coating liquid for a low-dyeable resin layer prepared with the following formulation, whereby a sublimation-type thermal image transfer recording medium No. 9 according to the present invention was prepared:

Preparation of Coating Liquid for Low-dyeable Resin Layer

Synthesis of Hydrolyzed Product of Silane Coupling Agent

A mixture of 12 g of dimethyldimethoxysilane and 160 g of methyltrimethoxysilane was hydrolyzed with the addition of 10 ml of a 3% sulfuric acid thereto for three hours, whereby a hydrolyzed product of a silane coupling agent for use in a low-dyeable resin layer was prepared.

The following components were mixed to prepare the above-mentioned coating liquid for the low-dyeable resin layer:

| | Parts by Weight |
|---|---|
| Styrene - acrylonitrile resin "Sanrex SAN-H" (Trademark) made by Mitsubishi Monsanto Chemical Co. | 5 |
| Hydrolyzed product of silane coupling agent | 1 |
| Sublimable dye "HSO144" (Trademark) made by Mitsui Toatsu Chemicals, Inc. | 5 |

-continued

| | Parts by Weight |
|---|---|
| Tetrahydrofuran | 20 |

EXAMPLE 10

The procedure for preparation of the sublimation-type thermal image transfer recording medium No. 3 in Example 3 was repeated except that the coating liquid for the low-dyeable resin layer employed in Example 3 was replaced by a coating liquid for a low-dyeable resin layer prepared with the following formulation, whereby a sublimation-type thermal image transfer recording medium No. 10 according to the present invention was prepared:

Preparation of Coating Liquid for Low-dyeable Resin Layer

Synthesis of Hydrolyzed Product of Silane Coupling Agent

A mixture of 50 g of dimethyldimethoxysilane and 20 g of methyltrimethoxysilane was hydrolyzed with the addition of 10 ml of a 3% sulfuric acid thereto for three hours, whereby a hydrolyzed product of silane coupling agent for use in the low-dyeable resin layer was prepared.

The following components were mixed to prepare the above-mentioned coating liquid for the low-dyeable resin layer:

| | Parts by Weight |
|---|---|
| Styrene - acrylonitrile resin "Sanrex SAN-H" (Trademark) made by Mitsubishi Monsanto Chemical Co. | 5 |
| Hydrolyzed product of silane coupling agent | 1 |
| Sublimable dye "HSO144" (Trademark) made by Mitsui Toatsu Chemicals, Inc. | 5 |
| Tetrahydrofuran | 20 |

EXAMPLE 11

The procedure for preparation of the sublimation-type thermal image transfer recording medium No. 3 in Example 3 was repeated except that the coating liquid for the low-dyeable resin layer used in Example 3 was replaced by a coating liquid for a low-dyeable resin layer prepared with the following formulation, whereby a sublimation-type thermal image transfer recording medium No. 11 according to the present invention was prepared:

Preparation of Coating Liquid for Low-dyeable Resin Layer

Synthesis of Hydrolyzed Product of Silane Coupling Agent

A mixture of 24 g of dimethyldimethoxysilane and 326 g of methyltrimethoxysilane was hydrolyzed with the addition of 10 ml of a 3% sulfuric acid thereto for three hours, whereby a hydrolyzed product of silane coupling agent for use in a low-dyeable resin layer was prepared. The following components were mixed to prepare a coating liquid for a low-dyeable resin layer:

| | Parts by Weight |
|---|---|
| Polydimethyl methacrylate "Dianal BR-85" (Trademark) made by Mitsubishi Rayon Engineering Co., Ltd. | 5 |
| Hydrolyzed product of silane coupling agent | 0.5 |
| Sublimable dye "HSO144" (Trademark) made by Mitsui Toatsu Chemicals, Inc. | 5 |
| Tetrahydrofuran | 20 |

Thermal Printing Test 3

Each of the sublimation-type thermal image transfer recording media No. 6 to No. 11 in Examples 6 to 11 according to the present invention was subjected to the same thermal recording test as in Thermal Printing Test 1 under the following conditions, using the same image receiving sheet as used in Thermal Printing Test 1:

| | |
|---|---|
| Resolution of thermal head: | 12 dots/mm |
| Applied energy: | 0.64 mJ/dot |
| Applied electric power: | 0.16 W/dot |
| [N = 1] | |
| Transporting speed of the image receiving sheet: | 8.4 mm/sec |
| Transporting speed of the thermal image transfer recording medium: | 8.4 mm/sec |
| [N = 7] | |
| Transporting speed of the image receiving sheet: | 8.4 mm/sec |
| Transporting speed of the thermal image transfer recording medium: | 1.2 mm/sec |
| [N = 14] | |
| Transporting speed of the image receiving sheet: | 8.4 mm/sec |
| Transporting speed of the thermal image transfer recording medium: | 0.6 mm/sec |
| [N = 21] | |
| Transporting speed of the image receiving sheet: | 8.4 mm/sec |
| Transporting speed of the thermal image transfer recording medium: | 0.4 mm/sec |

TABLE 3

| | Occurrence of Sticking | | | |
|---|---|---|---|---|
| | N = 1 | N = 7 | N = 14 | N = 21 |
| Ex. 6 | None | None | None | None |
| Ex. 7 | None | None | None | Slightly Observed |
| Ex. 8 | None | None | None | Slightly Observed |
| Ex. 9 | None | None | Slightly Observed | Observed |
| Ex. 10 | None | None | Slightly Observed | Slightly Observed |
| Ex. 11 | None | None | Observed | Observed |

As previously explained, the sublimation-type thermal image transfer recording media according to the present invention have the following advantages over the conventional sublimation-type thermal image transfer recording media:

(1) Because of a hydrolyzed product of a silane coupling agent contained in the top layer, excellent lubricating properties and heat-resistance can be obtained.

(2) Even when the n-times-speed mode method, which is carried out under relatively hard printing condition, is employed, the sticking problem does not occur, and images with high quality can be printed.

(3) When the ink layer is composed of a dye-supply layer, a dye-transfer layer, and a low-dyeable resin layer comprising a hydrolyzed product of a silane coupling agent, which are successively overlaid on a support, the heat-resistance and the lubricating properties of the low-dyeable resin layer can be improved. In the n-times-speed mode method, the occurrence of the sticking problem by the thermal fusion of the ink layer and an image receiving sheet can be prevented, the reverse transfer from the image receiving sheet to the sublimation-type thermal image transfer recording medium can be remarkably reduced when colors are superimposed, so that the problems of causing a ghost image, and drawing a tail at the edge portion of the image can be effectively solved. As a result, the multiple printing recording can be remarkably improved.

(4) The hydrolyzed product of the silane coupling agent contained in the top layer may comprise a mixture of a bifunctional silane coupling agent and a trifunctional silane coupling agent with a molar ratio of (2: 1) to (1: 10). By use of the hydrolyzed product, the lubrication properties of the bifunctional silane coupling agent and the high heat-resistance of the trifunctional silane coupling agent can be imparted to the top layer.

(5) The lubricating properties of the top layer can be further improved because the hydrolyzed product of the silane coupling agent therein has at least one methyl group.

(6) When the amount of the hydrolyzed product of the silane coupling agent is 20 to 200 parts by weight to 100 parts by weight of the low-dyeable resin layer, a recording medium capable of excellent printing performance, free from the sticking problem, can be obtained.

What is claimed is:

1. A sublimation thermal image transfer recording medium comprising:

a support;

a dye-containing layer formed on said support, which comprises a sublimable dye; and a top layer formed on said dye-containing layer, consisting essentially of a hydrolyzed product of a silane coupling agent.

2. The sublimation thermal image transfer recording medium as claimed in claim 1, wherein said dye-containing layer further comprises an organic binder agent in which said sublimable dye is dispersed.

3. The sublimation thermal image transfer recording medium as claimed in claim 1, wherein said dye-containing layer further comprises an organic binder agent in which said sublimable dye is dispersed, and said top layer further includes an organic binder agent.

4. The sublimation thermal image transfer recording medium as claimed in claim 1, wherein said hydrolyzed product of said silane coupling agent is a hydrolyzed product of a mixture of a bifunctional silane coupling agent and a trifunctional silane coupling agent.

5. The sublimation thermal image transfer recording medium as claimed in claim 4, wherein said hydrolyzed product of said silane coupling agent has a three-dimensional structure.

6. The sublimation thermal image transfer recording medium as claimed in claim 4, wherein the molar ratio of said bifunctional silane coupling agent to said trifunctional silane coupling agent is in the range of 2:1 to 1:10.

7. The sublimation thermal image transfer recording medium as claimed in claim 4, wherein said bifunctional silane coupling agent is selected from the group consisting of dimethyldichlorosilane, diphenyldichlorosilane, dimethyldimethoxysilane, dimethyldiethoxysilane, diphenyldimethoxysilane, γ-glycideoxypropylmethyldiethoxysilane, and N-β(aminoethyl)γ-aminopropylmethyldimethoxysilane, and said trifunctional silane coupling agent is selected from the group consisting of methyltrichlorosilane, phenyltrichlorosilane, methyltrimethoxysilane, phenyltriethoxysilane, γ-methacryloxypropyltrimethoxysilane, γ-aminopropyltrimethoxysilane, γ-aminopropyltriethoxysilane, and γ-chloropropyltrimethoxysilane.

8. The sublimation thermal image transfer recording medium as claimed in claim 1, wherein said hydrolyzed product of said silane coupling agent has at least one methyl group.

9. A sublimation thermal image transfer recording medium comprising:

a support;

a first dye layer formed on said support, and a second dye layer formed on said first dye layer, each of said first and second dye layers comprising a sublimable dye and an organic binder agent in which said sublimable dye is dispersed; and a top layer formed on top of said two dye-containing layers, consisting essentially of a hydrolyzed product of a silane coupling agent.

10. The sublimation thermal image transfer recording medium as claimed in claim 7, wherein said hydrolyzed product of said silane coupling agent is a hydrolyzed product of a mixture of a bifunctional silane coupling agent and a trifunctional silane coupling agent.

11. The sublimation thermal image transfer recording medium as claimed in claim 10, wherein said hydrolyzed product of said silane coupling agent has a three-dimensional structure.

12. The sublimation thermal image transfer recording medium as claimed in claim 10, wherein the molar ratio of said bifunctional silane coupling agent to said trifunctional silane coupling agent is in the range of 2:1 to 1:10.

13. The sublimation thermal image transfer recording medium as claimed in claim 10, wherein said bifunctional silane coupling agent is selected from the group consisting of dimethyldichlorosilane, diphenyldichlorosilane, dimethyldimethoxysilane, dimethyldiethoxysilane, diphenyldimethoxysilane, γ-glycideoxypropylmethyldiethoxysilane, and N-β(aminoethyl)γ-aminopropylmethyldimethoxysilane, and said trifunctional silane coupling agent is selected from the group consisting of methyltrichlorosilane, phenyltrichlorosilane, methyltrimethoxysilane, phenyltriethoxysilane, γ-methacryloxypropyltrimethoxysilane, γ-aminopropyltrimethoxysilane, γ-aminopropyltriethoxysilane, and γ-chloropropyltrimethoxysilane.

14. The sublimation thermal image transfer recording medium as claimed in claim 7, wherein said hydrolyzed product of said silane coupling agent has at least one methyl group.

15. A sublimation thermal image transfer recording medium comprising:

a support;

a dye-supply layer formed on said support, comprising a sublimable dye and an organic binder agent in which said sublimable dye is dispersed;

a dye-transfer layer formed on said dye-supply layer, comprising a sublimable dye and an organic binder agent in which said sublimable dye is dispersed; and a top layer formed on said dye-transfer layer, comprising a low-dyeable resin and a compound consisting essentially of a hydrolyzed product of a silane coupling agent.

16. The sublimation thermal image transfer recording medium as claimed in claim 15, wherein said top layer further comprises a sublimable dye.

17. The sublimation thermal image transfer recording medium as claimed in claim 16, wherein said dye-supply layer has a thickness of 0.1 to 20 μm, said dye-transfer layer has a thickness of 0.05 to 5 μn, and said top layer has a thickness of 0.05 to 5 μm.

18. The sublimation thermal image transfer recording medium as claimed in claim 16, wherein said sublimable dye is contained in said dye-supply layer in an amount of 5 to 80 wt. % of the total weight of said dye-supply layer.

19. The sublimation thermal image transfer recording medium as claimed in claim 16, wherein said sublimable dye is contained in said dye-transfer layer in an amount of 5 to 80 wt. % of the total weight of said dye-transfer layer.

20. The sublimation thermal image transfer recording medium as claimed in claim 16, wherein said sublimable dye is contained in said top layer in an amount of 5 to 80 wt. % of total weight of said low-dyeable resin layer.

21. The sublimation thermal image transfer recording medium as claimed in claim 16, the concentration of said sublimable dye in said dye-supply layer is 1.1 to 5 times the concentration of said sublimable dye in said dye-transfer layer.

22. The sublimation thermal layer image transfer recording medium as claimed in claim 15, wherein said hydrolyzed product of said silane coupling agent is a hydrolyzed product of a mixture of a bifunctional silane coupling agent and a trifunctional silane coupling agent.

23. The sublimation thermal image transfer recording medium as claimed in claim 22, wherein said hydrolyzed product of said silane coupling agent has a

24. The sublimation thermal image transfer recording medium as claimed in claim 22, wherein the molar ratio of said bifunctional silane coupling agent is said trifunctional silane coupling agent is in the range of 2:1 to 1:10.

25. The sublimation thermal image transfer recording medium as claimed in claim 22, wherein said bifunctional silane coupling agent is selected from the group consisting of dimethyldichlorosilane, diphenyldichlorosilane, dimethyldimethoxysilane, dimethyldiethoxysilane, diphenyldimethoxysilane, γ-glycideoxypropylmethyldiethoxysilane, and N-β(aminoethyl)γ-aminopropylmethyldimethoxysilane, and said trifunctional silane coupling agent is selected from the group consisting of methyltrichlorosilane, phenyltrichlorosilane, methyltrimethoxysilane, phenyltriethoxysilane, γ-methacryloxypropyltrimethoxysilane, γ-aminopropyltrimethoxysilane, γ-aminopropyltriethoxysilane, and γ-chloropropyltrimethoxysilane.

26. The sublimation thermal image transfer recording medium as claimed in claim 15, wherein said hydrolyzed product of said silane coupling agent has at least one methyl group.

27. The sublimation thermal image transfer recording medium as claimed in claim 15, wherein the amount of said hydrolyzed product of said silane coupling agent is 20 to 200 parts by weight to 100 parts by weight of said low-dyeable resin.

28. The sublimation thermal image transfer recording medium as claimed in claim 15, wherein said dye-supply layer has a thickness of 0.1 to 20 μm, said dye-transfer layer has a thickness of 0.05 to 5 μm, and said top layer has a thickness of 0.05 to 5 μm.

29. The sublimation thermal image transfer recording medium as claimed in claim 15, wherein said sublimable dye is contained in said dye-supply layer in an amount of 5 to 80 wt. % of the total weight of said dye-supply layer.

30. The sublimation thermal image transfer recording medium as claimed in claim 15, wherein said sublimable dye is contained in said dye-transfer layer in an amount of 5 to 80 wt. % of the total weight of said dye-transfer layer.

31. The sublimation thermal image transfer recording medium as claimed in claim 15, the concentration of said sublimable dye in said dye-supply layer is 1.1 to 5 times the concentration of said sublimable dye in said dye-transfer layer.

32. The sublimation image transfer recording medium as claimed in claim 15, wherein said dye-supply layer contains at least a sublimation dye in the form of granules.

33. The sublimation image transfer recording medium as claimed in claim 32, wherein said granules have a diameter of 0.01 to 20 μm.

34. The sublimation image transfer recording medium as claimed in claim 32, wherein said granules have a diameter of 1.0 to 5 μm.

* * * * *

UNITED STATES PATENT AND TRADEMARK OFFICE

CERTIFICATE OF CORRECTION

PATENT NO. : 5,348,931
DATED : September 20, 1994
INVENTOR(S) : Hidehiro Mochizuki, et. al.

It is certified that error appears in the above-indentified patent and that said Letters Patent is hereby corrected as shown below:

Item [57], col. 2,
On the title page, Abstract, Line 12, "a sublimable product" should read --a hydrolyzed product--.

Column 1, Line 33, "thereon. comprising" should read --thereon, comprising--.

Column 1, Line 64, "running, cost" should read --running cost--.

Column 2, Line 44, "portion o the" should read --portion of the--.

Column 2, Line 47, "the large the" should read --the larger the--.

Column 2, Line 56, "equalspeed mode" should read --equal-speed mode--.

Column 3, Line 38, "n-times-speed ode" should read --n-times-speed mode--.

UNITED STATES PATENT AND TRADEMARK OFFICE

CERTIFICATE OF CORRECTION

PATENT NO. : 5,348,931
DATED : September 20, 1994
INVENTOR(S) : Hidehiro Mochizuki, et. al.

It is certified that error appears in the above-indentified patent and that said Letters Patent is hereby corrected as shown below:

Column 12, Line 43, "Applied Energy: 0.65 mJ/dot" should read --Applied Energy: 0.64 mJ/dot--.

Column 15, Line 36, please insert --Example 5--.

Column 16, Line 8, please insert --Comparative Example 5--.

Column 20, Line 45, please insert --The results of the test are shown in Table 3--.

Column 22, line 29, "Claim 7" should read --Claim 9--.

Column 22, line 56, "Claim 7" should read --Claim 9--.

Column 23, Line 11, "0.05 to 5μn" should read --0.05 to 5μm--.

UNITED STATES PATENT AND TRADEMARK OFFICE

CERTIFICATE OF CORRECTION

PATENT NO. : 5,348,931

DATED : September 20, 1994

INVENTOR(S) : Hidehiro Mochizuki, et. al.

It is certified that error appears in the above-indentified patent and that said Letters Patent is hereby corrected as shown below:

Column 23, Line 32, "thermal layer image" should read --thermal image--.

Column 23, Line 39, after "has a", please insert --three-dimensional structure--.

Signed and Sealed this

Twenty-second Day of October, 1996

Bruce Lehman

*Attest:*

BRUCE LEHMAN

*Attesting Officer*

*Commissioner of Patents and Trademarks*